United States Patent [19]

Kakuwa et al.

[11] 4,225,294

[45] Sep. 30, 1980

[54] OIL SEAL MEANS FOR ROTARY PISTON ENGINES INCLUDING A NITRIDED AND GROUND SURFACE

[75] Inventors: Seiichi Kakuwa; Toshihiko Hattori; Ichiro Yamagata; Toshio Yamada, all of Hiroshima, Japan

[73] Assignee: Toyo Kogyo Co., Ltd., Hiroshima, Japan

[21] Appl. No.: 913,337

[22] Filed: Jun. 7, 1978

[30] Foreign Application Priority Data

Jun. 10, 1977 [JP] Japan ..... 52-69002

[51] Int. Cl.³ ..... F01C 19/08; F01C 21/04

[52] U.S. Cl. ..... 418/142; 418/178; 418/179; 29/156.4 WL

[58] Field of Search ..... 418/142, 178, 179; 29/156.4 WL

[56] References Cited

U.S. PATENT DOCUMENTS

| | | | |
|---|---|---|---|
| Re. 28,918 | 7/1976 | Humbert | 418/178 |
| 3,456,624 | 7/1969 | Okamoto | 418/178 |
| 3,575,537 | 4/1971 | Yamamoto et al. | 418/178 |
| 3,712,767 | 1/1973 | Beutter | 418/178 |
| 3,827,920 | 8/1974 | Shimoda et al. | 418/178 |
| 3,833,320 | 9/1974 | Telang et al. | 418/178 |

*Primary Examiner*—John J. Vrablik

*Attorney, Agent, or Firm*—Fleit & Jacobson

[57] ABSTRACT

The side housing of a rotary piston engine has an inner surface which has been subjected to a soft-nitriding treatment to form a layer of Fe-C-N type compounds and thereafter ground to provide a surface roughness of between 0.3 and 15 microns. An oil seal which slidably engages the inner surface of the side housing has a sealing lip constituted by a chromium plating. The arrangement provides an improved wear resistance of the oil seal.

6 Claims, 5 Drawing Figures

OIL SEAL MEANS FOR ROTARY PISTON ENGINES INCLUDING A NITRIDED AND GROUND SURFACE

The present invention relates to rotary piston engines and more particularly to improvements in side housings and oil seals therefor.

Conventional rotary piston engines include a casing comprised of a rotor housing having a multi-lobed trochoidal inner wall surface and a pair of side housings secured to the opposite sides of the rotor housing to define a rotor chamber, and a substantially polygonal rotor disposed in the rotor chamber for rotation with apex portions in sliding contact with the inner wall surface of the rotor housing. The term "side housing" as herein used is intended to include so-called intermediate housings which are adapted to be positioned between rotor housings in multiple-rotor type rotary piston engines. In the rotary piston engine, a working chamber is defined between each flank of the rotor, the inner wall surface of the rotor housing and the inner surfaces of the paired side housings.

Thus, it will be noted that the inner surface of the side housing is subjected to heat of combustion and to various corrosive substances such as HC, CO, $CO_2$, $H_2O$, $SO_3$, $NO_2$ and $H_2S$ which are applied or produced through combustion process. Therefore, the side housing is required to possess a resistant property against heat as well as against corrosion at least at the inner surface. Further, the inner surface of the side housing is slidably engaged with various kinds of seals such as oil seals, side seals, end surfaces of apex seals and corner seals which are made of relatively hard materials and slidably move along the inner surface of the side housing at high speeds, so that the side housing is also required to be of wear-resistant and lubricant-retaining properties.

Among the seals, the oil seals impose the most severe conditions to the side housings. The seals other than oil seals are mostly intended to provide gas-tightness so that they may make surface contacts with the inner surfaces of the side housings. However, the oil seals are aimed to scrape lubricant oil off the inner surfaces of the side housings, so that they are designed to make line contacts with the side housings.

Typical example of conventional oil seals for rotary piston engines is disclosed by the U.S. Pat. No. 3,456,624. This known type of oil seal comprises a circular base member made of cast iron having high phosphorous and boron contents. The base member is chromium plated at the radially inner surface to provide a sealing lip. However, this type of oil seal has been found disadvantageous in that the wear-resistant property is insufficient so that the width or area of contact of the sealing lip is gradually increased to destroy sealing performance. Thus, it has been difficult to maintain an adequate oil retaining property by this design of oil seal.

It has been recognized that the oil consumption increases remarkably in response to an increase in the width or area of contact of the sealing lip so that efforts have been made for preventing the increase in the width of the sealing lip. The U.S. Patent application Ser. No. 799,980 filed on May 24, 1977, now U.S. Pat. No. 4,132,419, proposes one successful solution for the problem. According to the proposal, the sealing lip is formed of a hard sintered composite material attached to the base member. The proposal provides to a certain extent satisfactory result, however, it is still desirable to make further improvements.

It is therefore an object of the present invention to provide a rotary piston engine having oil seals of superior wear resistant property.

Another object of the present invention is to provide a combination of side housings and oil seals which can provide superior wear-resistant property.

According to the present invention, the above and other objects can be accomplished by a rotary piston engine comprising a casing which includes a rotor housing having a trochoidal inner wall surface and a pair of side housings secured to the opposite sides of the rotor housing to define a rotor chamber by inner surfaces of the side housings and the inner wall surface of the rotor housing, and a substantially polygonal rotor having side surfaces and disposed in said rotor chamber for rotation with apex portions in sliding contact with the inner wall surface of the rotor housing, said rotor being formed at the side surfaces with oil seal grooves for receiving oil seals which are adapted to be brought into sliding contact with the inner surfaces of the side housings, each of said side housings being formed of iron-based material and including at the inner surfaces a layer of Fe-C-N compounds produced through a soft-nitriding treatment, said layer being of thickness not less than 1.0 microns, said side housing having surface roughness of between 0.3 and 15 microns, each of said oil seals having a sealing lip with hard chromium plating.

According to a preferable aspect of the present invention, the side housing is made of a cast iron and the layer of Fe-C-N type compounds has a surface comprised of plateaus and pores, said plateaus having surface roughness of 0.3 to 1.5 microns, said pores being of depths between 1.0 and 300 microns and occupying 5 to 50% of the surface.

The present invention is based on the inventors' finding that, although a cast iron oil seal having a chromium plated sealing lip has been believed as being disadvantageous in respect of wear-resistant property, such oil seal shows an unexpectedly good wear-resistant property when it is used on a particular surface. Thus, the present invention is characterized by the fact that the side housing has the inner surface of the aforementioned construction and the oil seal is used against such surface.

According to the present invention, there is also provided a method of manufacturing a side housing of a rotary piston engine which comprises steps providing a side housing blank made of iron-based material, applying soft-nitriding treatment to at least one surface of the blank to produce a layer of Fe-C-N compounds, and grinding said surface at least at an area which will be brought into sliding contact with an oil seal so as to provide a surface roughness of 0.3 to 15 microns.

The oil seal may be prepared in accordance with a conventional manner. For example, it may comprise a circular base member made of cast iron having a high phosphorous and boron content and having a chromium plated layer at the radially inner surface thereof, said base member having a surface confronting to the inner surface of the side housing and inclined in such a manner that an edge of the chromium plated layer is contacted with the inner surface of the side housing. The width of the contact area of the oil seal should preferably be 0.1 to 0.3 mm.

As previously discussed, the side housing must possess a wear-resistant property as well as oil-retaining property so that it is not worn and it does not injure the sealing material when the sealing material is slidably moved at a high speed along the surface of the side housing. As well known in the art, soft-nitriding treatment produces a layer of Fe-C-N compounds which is of substantial hardness, however, the surface is of extremely irregular configuration so that it will cause a significant wear on the lip portion of the oil seal after a prolonged time of idling operation, when it is used as a side housing of a rotary piston engine. This is understood as being caused by the fact that the irregular surface on the side housing is ground during the low speed engine operation to produce free particles of compounds so that the oil seal is worn or scratched by the particles.

According to the present invention, the above problem is solved by grinding the soft-nitrided hard surface to produce a surface roughness of less than a predetermined value. However, since the inner surface of the side housing is adapted to be slidably engaged with various seals, a further problem will be produced if the surface roughness of the inner surface of the side housing is of excessively small value. More specifically, if the surface roughness is of too small value, the lubricant oil film on the surface will be destroyed and there will be a lack of lubrication resulting in seizing or abnormal wear of slidable parts. Therefore, the present invention proposes to retain certain amount of irregularities in the soft-nitrided surfaces to maintain an oil-retaining or lubricating property of the surface.

It will thus be noted that the roughness of the compound layer on the side surface must be of a value which is satisfactory in respect both of the wear-resistance and of lubrication. From this point of view, the inventors have found that the surface roughness must be 0.3 to 15 microns. With the surface roughness smaller than 0.3 microns, adequate lubrication will not be established but, with the roughness greater than 15 microns, there will be an adverse effect on the wear resistance. More preferably, the surface roughness should be 0.5 to 7.0 microns. The thickness of the compound layer must be greater than 0.1 micron in view of the durability and the corrosion resistance.

The inner surface of the side surface with which the oil seal is slidably engaged is exposed to the combustion space and constitutes a wall surface of the space. Therefore, the inner surface of the side housing must withstand combustion heat and corrosive gaseous substances in the combustion gas. When there is produced even a small corrosion, materials around the corroded area are further mechanically broken off and at the same time the seals are damaged or abnormally worn by the corroded area. The corroded area on the side housing and the wear on the seals are rapidly spread ultimately affecting adversely on the performance of the engine. The soft-nitrided inner surface of the side housing has been found as having satisfactory resistance to corrosion.

In order to produce a layer of Fe-C-N type compounds through a soft-nitriding treatment, it is of course required to use an iron-based material and a cast-iron or steel, particularly cast steel may be used for the purpose. More specifically, referring to materials in accordance with JAPANESE INDUSTRIAL STANDARD (JIS), use may be preferably made of a cast iron such as FCH-1, FCH-2, FCD 45 or FCD 55, a steel such as SACM 1, SCR 4 or S 55C, anyone of Types 2 to 4 of Mn-Cr type cast steel, or anyone of Types 1 and 3 of Cr-Mo type cast steel. Since it is inconvenient to manufacture the side housing totally from a steel material, a recommendable way in using a steel material in the side housing is to provide the inner surface portion by a sheet of steel which is supported by a body made of a cast iron.

A cast iron, particularly flake graphite cast iron is one of preferable materials for the side housing. When a flake graphite cast iron is nitrided, there will be no intimate contact between the graphite flakes and the compounds produced through the nitriding. Further, the graphite flakes themselves become fragile due to decarbonization. Moreover, due to thermal expansion and succeeding contraction produced in the cast iron body, the graphite flakes are in conditions readily removable from the base metal of the cast iron. Thus, when the cast iron surface is subjected to grinding operation, portions or substantial parts of the compounds formed on the graphite flakes fall off producing pores in the surface. The pores thus formed function to retain lubricant oil and improve the lubricating property of the surface.

The depths and the number of the pores are dependent on the amount and the configuration of graphite in the cast iron, and the conditions under which the soft-nitriding treatment and the surface grinding are performed. Through the experiments, the inventors have found that in most cases the depth of the pores is 1 to 300 microns and the pores occupy 5 to 50% of the surface area even though the conditions for the nitriding treatment is changed within possible range and the grinding process is performed in various possible ways.

In manufacturing the side housing in accordance with the present invention, a blank of the side housing is at first prepared. When the blank is to be made totally of a cast iron or a cast steel, a casting process may be adopted for preparing the blank. When the blank includes a sliding surface portion made of a steeel plate, a body of the side housing may be formed behind the steel plate through a casting process. Thereafter, the blank is machined into a desired configuration and then subjected to a nitriding treatment at the inner surface.

In this instance, the nitriding treatment may be applied only to such area of the inner surface of the side housing that is slidably engaged with the oil seal, but it may also be applied throughout the inner surface of the side housing because preferable results will also be obtained by nitriding even other portions such as those areas that are brought into sliding contact with side seals, corner seals and apex seals, those areas exposed to combustion spaces and those areas which are engaged with the rotor housing.

The soft-nitriding treatment can be performed in accordance with any one of conventional processes. One of such known processes is a gas soft-nitriding method in which the workpiece is maintained under an atmosphere of cementation converted gas and ammonia gas at 500° to 590° C. for 1 to 6 hours. Another known process is a so-called Tufftride method in which the workpiece is dipped in a salt bath mainly constituted by KCN+KCNO or NaCN+NaCNO with additives such as $BaCO_3$ or $Na_2CO_3$ under a temperature of 500° to 590° C. for 1 to 6 hours.

Surface grinding is very important in manufacturing the side housing in accordance with the present invention. The purpose of the surface grinding is to reduce the surface irregularities within a predetermined value. Conventional honing or lapping process may be adopted for the purpose. Surface grinding may even be performed after the side housing has been assembled in an engine by operating the engine frequently replacing lubricant oil. However, the latter method is not recommendable because it produces rapid wear of seals.

Referring to the surface roughness of the Fe-C-N type compound layer, it can be measured by scanning the surface with a probe and the result of the measurement is understood as being a sum of the roughness of the surface of the blank prior to nitriding and the roughness of the surface of the compound. Thus, it is necessary to control strictly the surface roughness of the blank. The allowable surface roughness of the blank is approximately 2 microns. In determining the surface roughness, those values extremely apart from general or average values are omitted from the measured values since they may be caused by cracks or scratches on the surface but may not represent surface roughness.

In the present invention, it should be understood that the layer of Fe-C-N type compounds is the one which has been produced through a soft-nitriding process so that it may contain small amount of other elements such as oxygen, chromium and aluminum which might have been contained in the base metal or brought from the atmosphere.

The present invention will further be described with reference to the accompanying drawings, in which.

Figure 1:
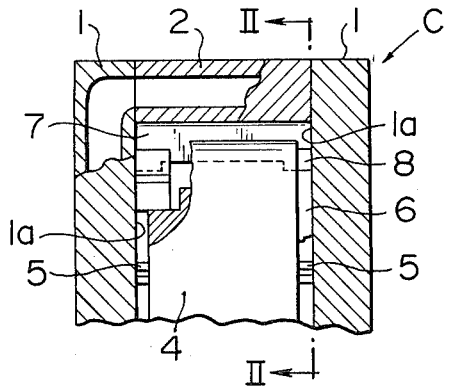
FIG. 1 is a fragmentary sectional view of a rotary piston engine in which the features of the present invention can be embodied.
Figure 2:
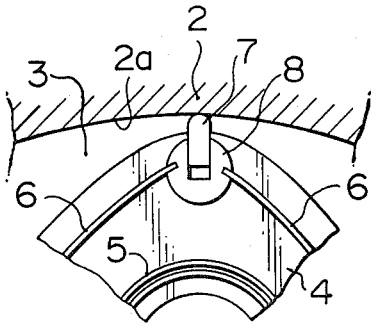
FIG. 2 is a sectional view taken along the line II—II in FIG. 1.

Referring now to the drawings, particularly to FIGS. 1 and 2, the rotary piston engine shown therein includes a casing C which is comprised of a rotor housing 2 having a trochoidal inner wall surface 2*a* and a pair of side housings 1 having inner surfaces 1*a* and secured to the opposite sides of the rotor housing 2 to define a rotor chamber 3 therein. In the casing C, there is disposed a substantially triangular rotor 4 which is rotatable in the casing C. The rotor 4 has side surfaces 4*a* which are opposed to the inner surfaces 1*a* of the side housings 1.

On each side surface 4*a* of the rotor 4, there is disposed a circular oil seal 5 and side seals 6. Further, the rotor 4 carries an apex seal 7 and a corner seal 8 on each apex portion.

Figure 3:
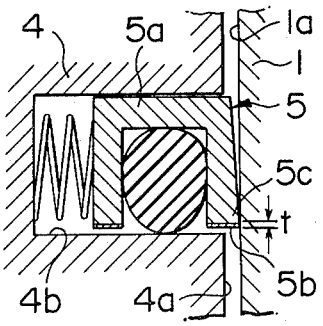
FIG. 3 is a fragmentary sectional view showing an example of the oil seal arrangement.

Referring now to FIG. 3, it will be noted that the rotor 4 is provided at each side surface 4*a* with a groove 4*b* and the oil seal 5 is received in the groove 4*b*. The oil seal 5 is of a channel shaped cross-section having a base 5*a* made of a cast iron having high phosphorous and boron contents. The oil seal 5 is chromium plated at the radially inward side as shown by 5*b* and the side facing to the side housing 1 is inclined to form a sealing lip 5*c* at the radially inward side which is adapted to engage the inner surface 1*a* of the side housing 1 with a lip width t. In accordance with the features of the present invention, each side housing 1 is applied at the inner surface with soft-nitriding treatment as previously discussed to form a layer of Fe-C-N type compounds and the surface is thereafter ground to a surface roughness of 0.3 to 1.5 microns.

The present invention will further be described with reference to specific examples so that the advantageous features of the invention can well be recognized.

EXAMPLES

Specimens of side housings have been prepared as follows.

Specimen 1:

Base Material; Flake graphite cast iron in accordance with Japanese Industrial Standard (JIS) FCH-2 having a surface roughness of 1.0 microns.

Soft-Nitriding; Gas method with an atmosphere constituted by 50% of Rx gas and the balance of $NH_4$ gas at 570° C. for 4 hours. After the soft-nitriding treatment, the surface roughness was 20 microns.

Surface Grinding; Shot blasting process with alumina sand No. 120, blasting pressure 3 Kg/cm$^2$, blasting distance 200 mm, blasting angle 30° and the blasting time 25 minutes. After the process, the surface roughness was 8 to 10 microns and the thickness of the compound layer was 5 to 7 microns.

Specimen 2:

Base Material; Steel in accordance with JIS SACM-1 having a surface roughness of 0.8 microns.

Soft-Nitriding; Same as in specimen 1.

Surface Grinding; Lapping process with an oil stone of No. 200, the back-up pressure 0.4 Kg/cm$^2$, the process time 10 minutes. After the process the surface roughness was 1 to 3 microns and the thickness of the layer was 8 to 10 microns.

Specimen 3:

Base Material; Same as in specimen 1 having a surface roughness of 1.2 microns.

Soft-Nitriding; Tufftride method with a treating solution containing 43% of $KCNO_3$, 0.1% of $Na[Fe(CN)_6]$ and the balance of KCN at 570° C. for 3 hours.

Surface Grinding; Actual operation after assembling in an engine at 2500 rpm for 2 hours. The surface roughness was 5 to 7 microns and the thickness of layer was 3 to 5 microns.

The oil seals were of circular configuration having an outer diameter of 130 mm, an inner diameter of 124 mm and a height of 6.0 mm with a cross-sectional configuration as shown in FIG. 3. The base material was a cast iron having high phosphorous and boron contents with a chromium plated layer of 0.15 mm thick at the radially inward surface as shown by 5*b* in FIG. 3.

The specimens were subjected to the following wear tests.

TEST 1

Figure 4:
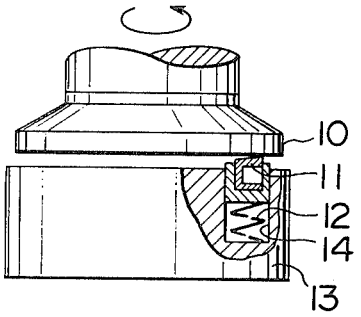
FIG. 4 is a view of an oil seal testing device.
Figure 5:
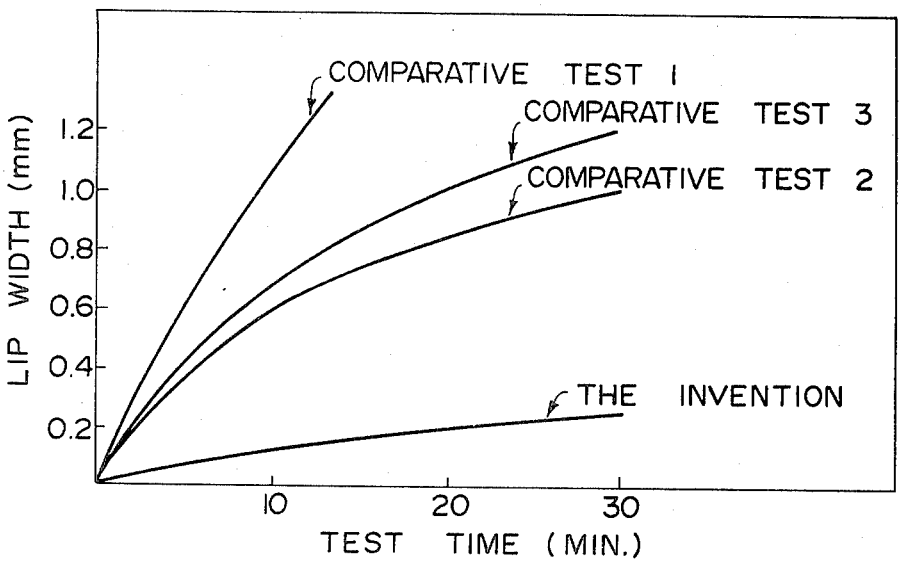
FIG. 5 is a diagram showing wear of the oil seal lip.

With the specimen 1, a rotatable disc 10 was prepared as shown in FIG. 4. The disc 10 was placed against a base 13 having an oil seal 11 of 10 mm long which is received in a groove 14 of the base 13 and forced toward the disc 10 by a spring 12 under a bias force of 5.5 Kg. The disc 10 was driven so that the oil seal 11 slides along the disc surface with a linear speed of 5.2 m/sec. No lubricant was used. After the test, the amount of wear was measured and the result is shown in FIG. 5.

Similar tests have been made on two types of conventional arrangements as follows.

PRIOR ART 1

The same type of oil seal was used against a cast iron side housing without any soft-nitriding treatment.

PRIOR ART 2

The side housing as in the prior art 1 was used with an oil seal having a sealing lip made of a sintered material.

A further test was also made on a combination of an oil seal as in the prior art 2 and a soft-nitrided side housing. The results of those tests are shown in FIG. 5 as the comparative tests 1 through 3, respectively.

In FIG. 5, it will be noted that the embodiment of the present invention shows a remarkably excellent wear resistant property. It should particularly be noted that the chromium plated oil seal which has been considered as being undesirable in respect of wear resistance shows a remarkably improved result only when it is used with a side housing which has been soft-nitrided and ground to a predetermined surface roughness.

TEST 2

The specimens were then tested in actual engines.

(1) Manner of Test (a) Tested Engine: A two rotor type rotary piston engine having a single working chamber displacement of 654 cc and an engine maximum output of 135 ps.

(b) Test Condition: The engine was subjected to an operation of 9000 cycles, each cycle being consisted of operation under a full load at 7000 rpm for 60 seconds and rapidly decelerate to 3000 rpm, the duration time of each cycle being 75 seconds. After the test, the lip width was measured.

(2) Test Results

The test results are shown in Table I.

Table I

| | LIP WIDTH (mm) | LIP WIDTH BEFORE TEST |
|---|---|---|
| SPECIMEN 1 | 0.40 | 0.20 |
| SPECIMEN 2 | 0.50 | 0.20 |
| SPECIMEN 3 | 0.40 | 0.20 |
| COMPARATIVE 4 | 0.75 | 0.20 |

As the comparative 4, the combination as in the specimen 1 was used with the exception that the side housing was used without soft-nitriding treatment.

TEST 3

(1) Manner of Tests (a) Tested Engine: As in the Test 2.

(b) Test Condition: The engine was operated under no load at a low cooling water temperature (less than 35° C.) and at 800 rpm for 100 hours. The oil seal lip width was then measured.

(c) Tested Housing: As an embodiment of the present invention, the specimen 1 was used. As comparative specimens, the comparative 4 as in the test 2 and a further comparative specimen 5 were tested. The comparative 5 used a soft-nitrided housing without surface grinding.

(2) Test Results

The results are shown in Table II.

Table II

| | LIP WIDTH (mm) | LIP WIDTH BEFORE TEST |
|---|---|---|
| SPECIMEN 1 | 0.22 | 0.20 |
| COMPARATIVE 4 | 0.68 | 0.20 |
| COMPARATIVE 5 | 0.75 | 0.20 |

From the above tests, it will be noted that the embodiments of the present invention have remarkably superior wear resistance and it has been proved that the engines equipped with the oil seal arrangements can withstand more than 200,000 Km of operation with either of the combinations of the specimens 1 through 3. The results of the test 3 shows that a simple soft-nitriding is not an adequate solution for improving the wear resistance of the oil seal but surface grinding after the soft-nitriding is also very important.

The invention has thus been shown and described with reference to specific examples, however, it should be noted that the invention is in no way limited to the details of such examples but changes and modifications may be made without departing from the scope of the appended claims.

What is claimed is:

1. Rotary piston engine comprising a casing which includes a rotor housing having a trochoidal inner wall surface and a pair of side housings secured to the opposite sides of the rotor housing to define a rotor chamber by inner surfaces of the side housings and the inner wall surface of the rotor housing, and a substantially polygonal rotor having side surfaces and disposed in said rotor chamber for rotation with apex portions in sliding contact with the inner wall surface of the rotor housing, said rotor being formed at the side surfaces with oil seal grooves for receiving oil seals which are adapted to be brought into sliding contact with the inner surfaces of the side housings, each of said side housings being formed of iron-based material and including at the inner surfaces a layer of Fe-C-N compounds produced through a soft-nitriding treatment, said layer being of thickness not less than 1.0 microns, said side housing having a surface comprised of plateaus and pores, said plateaus having a surface roughness of between 0.3 and 15 microns, and said pores having depths between 1.0 and 300 microns for retaining lubricant to improve the lubricating property of said surface, and each of said oil seals having a sealing lip with hard chromium plating.

2. Rotary piston engine in accordance with claim 1 in which said iron-based material for forming said side housing is a cast iron.

3. Rotary piston engine in accordance with claim 1 in which said pores occupy 5 to 50% of the surface.

4. Rotary piston engine in accordance with claim 1 in which said chromium plating at the sealing lip of the oil seal is 0.1 to 0.3 mm thick.

5. Method for manufacturing a side housing of a rotary piston engine which comprises: providing a side housing blank made of iron-based material, applying soft-nitriding treatment to at least one surface of the blank to produce a layer of Fe-C-N compounds not less than 1.0 microns thick, and grinding at least an area of said surface which will be brought into sliding contact with an oil seal so that parts of the layer fall off thereby providing a surface comprised of plateaus and pores, said plateaus having a surface roughness of 0.3 to 15 microns, and said pores having depths between 1.0 and 300 microns for retaining lubricant, said grinding being performed by a shot-blasting process.

6. Method for manufacturing a side housing of a rotary piston engine which comprises: providing a side housing blank made of iron-based material, applying soft-nitriding treatment to at least one surface of the blank to produce a layer of Fe-C-N compounds not less than 1.0 microns thick, and grinding at least an area of said surface which will be brought into sliding contact with an oil seal so that parts of the layer fall off thereby providing a surface comprised of plateaus and pores, said plateaus having a surface roughness of 0.3 to 15 microns, and said pores having depths between 1.0 and 300 microns for retaining lubricant, said grinding being performed by a lapping process.

* * * * *